US011397068B2

(12) United States Patent
Lee et al.

(10) Patent No.: US 11,397,068 B2
(45) Date of Patent: Jul. 26, 2022

(54) CONFIGURABLE CABLE HOLDER FOR FIREARMS

(71) Applicant: Strike Industries, Inc., Santa Ana, CA (US)

(72) Inventors: Shanyao Lee, Santa Ana, CA (US); Hung-Ju Lee, Santa Ana, CA (US)

(73) Assignee: Strike Industries, Inc., Santa Ana, CA (US)

( * ) Notice: Subject to any disclaimer, the term of this patent is extended or adjusted under 35 U.S.C. 154(b) by 0 days.

(21) Appl. No.: 17/086,140

(22) Filed: Oct. 30, 2020

(65) Prior Publication Data

US 2022/0136800 A1 May 5, 2022

(51) Int. Cl.
*F41C 27/00* (2006.01)

(52) U.S. Cl.
CPC ..... *F41C 27/00* (2013.01)

(58) Field of Classification Search
CPC ..... F41C 27/00
See application file for complete search history.

(56) References Cited

U.S. PATENT DOCUMENTS

| | | | | |
|---|---|---|---|---|
| 1,945,932 | A * | 2/1934 | Caley | A45D 2/18 132/247 |
| 4,998,326 | A * | 3/1991 | Oetiker | F16L 33/035 24/20 R |
| D325,802 | S * | 4/1992 | Peterson | D34/35 |
| 7,404,238 | B2 * | 7/2008 | McNeill | B65D 63/1027 24/16 PB |
| D612,895 | S * | 3/2010 | Stein | D21/573 |
| D825,487 | S * | 8/2018 | Munson | D13/155 |
| D840,789 | S * | 2/2019 | Chen | D8/356 |
| D874,905 | S * | 2/2020 | Gaddy | D8/356 |
| 2009/0014478 | A1 * | 1/2009 | Bellinger, Jr. | B65D 83/303 222/538 |
| 2013/0233597 | A1 * | 9/2013 | Suiter | H02G 1/00 174/135 |
| 2016/0157896 | A1 * | 6/2016 | Palmer | A61B 17/7041 606/278 |
| 2017/0001778 | A1 * | 1/2017 | Leang | F16L 3/237 |
| 2018/0366926 | A1 * | 12/2018 | Schulte | F16L 3/127 |
| 2021/0108891 | A1 * | 4/2021 | Ma | F41G 11/003 |

* cited by examiner

*Primary Examiner* — Michelle Clement
(74) *Attorney, Agent, or Firm* — Han IP PLLC; Andy M. Han

(57) ABSTRACT

Various examples of a configurable cable holder for firearms are described. One example of the configurable cable holder includes an elastic band. The elastic band is configured to wrap around a portion of the firearm in one of a plurality of configurations when installed on the firearm. The elastic band has a clamp portion configured to elastically clamp a portion (e.g., cable) of an accessory of the firearm.

20 Claims, 8 Drawing Sheets

CONFIGURABLE CABLE HOLDER FOR FIREARMS

TECHNICAL FIELD

The present disclosure is generally related to firearms and, more particularly, to a configurable cable holder for firearms.

BACKGROUND

Unless otherwise indicated herein, approaches described in this section are not prior art to the claims listed below and are not admitted as prior art by inclusion in this section.

On firearms such as rifles, carbines and pistols based on the AR-15, AR-10 or AK platform as well as shotguns, it is customary for a user to mount one or more accessories on the firearm to enhance one or more aspects such as, for example, handling of the firearm, illumination of an area in front of the firearm, vision in a relatively dark environment, and/or accuracy in shot placement. For instance, an electronic device such as a light and/or laser may be mounted toward the front and near the muzzle of the firearm while the control thereof (e.g., buttons for power on/off and adjustments) may be mounted somewhere behind the light/laser for easier and faster access to the control by the user. In such cases, there is usually an electric cable connecting the control and the light/laser. However, if the cable is not properly secured and routed, the setup could be unruly and could hinder the operation and/or handling of the firearm.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

An objective of the present disclosure is to provide innovative designs of a configurable cable holder that addresses aforementioned issues associated with conventional dust covers. For instance, a configurable cable holder under various proposed schemes in accordance with the present disclosure may be utilized in different configurations to hold and secure a cable on a firearm.

In one aspect, a device implementable on a firearm (e.g., a firearm based on the AR-15, AR-10 or AK platform) may include an elastic band configured to wrap around a portion of the firearm (e.g., handguard, grip or buttstock) in one of a plurality of configurations when installed on the firearm. The elastic band may have a clamp portion configured to elastically clamp a portion (e.g., cable) of an accessory of the firearm.

In another aspect, a device implementable on a firearm (e.g., a firearm based on the AR-15, AR-10 or AK platform) may include an elastic band configured to wrap around a portion of the firearm (e.g., handguard, grip or buttstock) in one of a plurality of configurations when installed on the firearm. The elastic band may have a clamp portion configured to elastically clamp a portion (e.g., cable) of an accessory of the firearm. In some implementations, when the elastic band wraps around the portion of the firearm in a first configuration of the plurality of configurations, the clamp portion may protrude away from the firearm. Moreover, when the elastic band wraps around the portion of the firearm in a second configuration of the plurality of configurations, the clamp portion may protrude toward the firearm.

BRIEF DESCRIPTION OF THE DRAWINGS

The accompanying drawings are included to provide a further understanding of the disclosure, and are incorporated in and constitute a part of the present disclosure. The drawings illustrate implementations of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED IMPLEMENTATIONS

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

Overview

Under various proposed schemes in accordance with the present disclosure, a device implementable on a firearm (e.g., an AR-style firearm, an AK-style firearm or a shotgun) may include a configurable cable holder 100 that is configured with one or more cable holders and may be utilized in different configurations. Detailed description of configurable cable holder 100 is provided below with reference to FIG. 1-FIG. 8.

Figure 1:
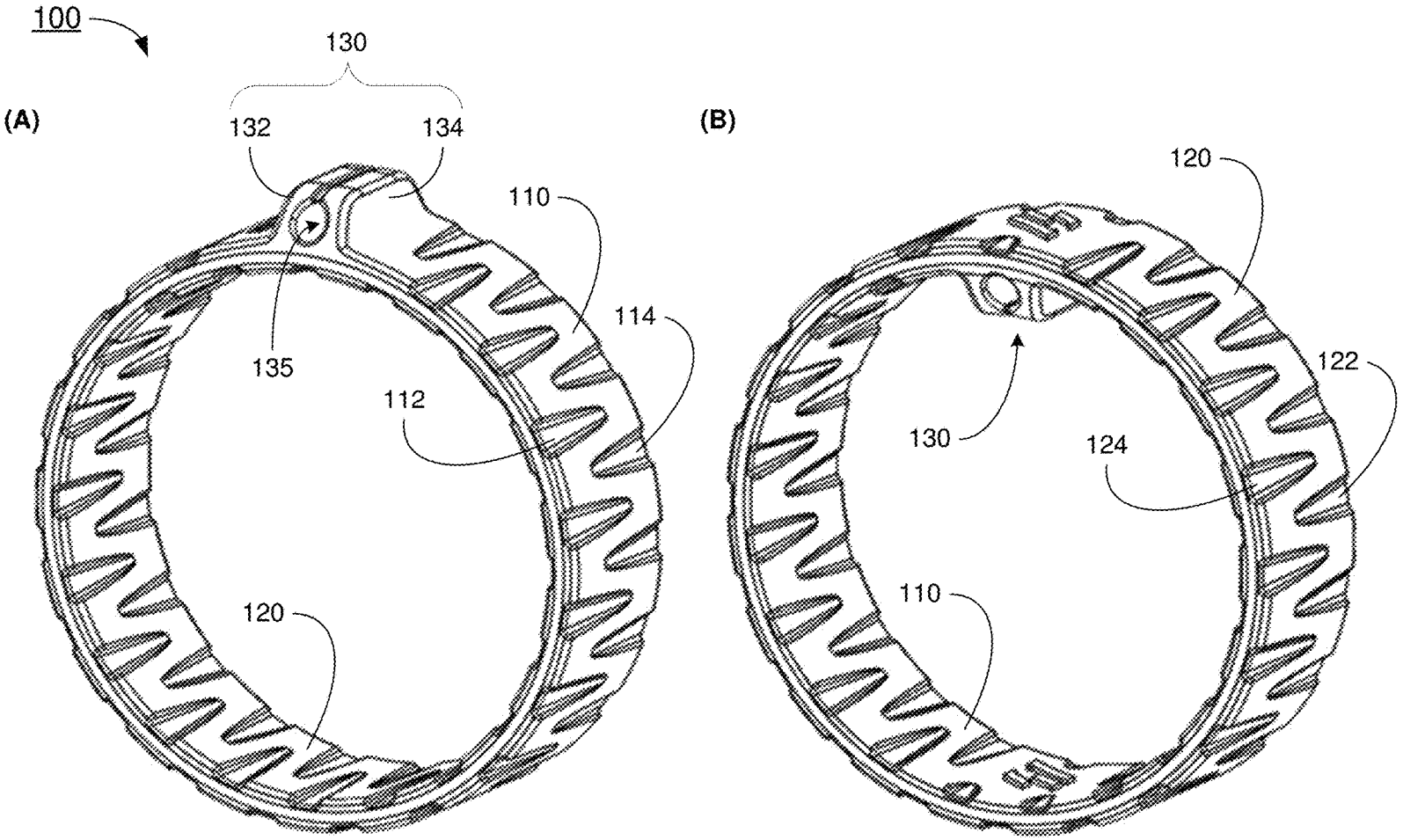
FIG. 1 is a diagram of two configurations of a configurable cable holder in accordance with an implementation of the present disclosure.

FIG. 1 illustrates two configurations of a configurable cable holder 100 in accordance with an implementation of the present disclosure. Under various proposed schemes in accordance with the present disclosure, configurable cable holder 100 may be in the form of an elastic band that is configured to wrap around a portion of the firearm (e.g., handguard, grip or buttstock) in one of a plurality of configurations when installed on the firearm. For instance, configurable cable holder 100 may be in the form of an elastic band made of nitrile rubber, also known as NBR, Buna-N, and acrylonitrile Butadiene rubber. Alternatively, configurable cable holder 100 may be made of rubber, thermoplastic polyurethane (TPU), silicone, or another elastic material.

Referring to FIG. 1, configurable cable holder 100, as an elastic band, may have a first surface 110 and a second surface 120 opposite the first surface 110. Part (A) of FIG. 1 shows configurable cable holder 100 in a first configuration of the plurality of configurations. When in the first configuration, first surface 110 faces outwardly and second surface 120 faces inwardly. Part (B) of FIG. 1 shows configurable cable holder 100 in a second configuration of the plurality of configurations. When in the second configuration, second surface 120 faces outwardly and first surface 110 faces inwardly.

Under a proposed scheme in accordance with the present disclosure, each of first surface 110 and second surface 120 may be textured to provide an anti-slip effect as well as good tensile. For instance, each of first surface 110 and second surface 120 may be textured with a plurality of indentations, respectively. As shown in part (A) of FIG. 1, the plurality of indentations on first surface 110 may include: (1) a first group of indentations 112 extending from a first side (e.g., left side as shown in part (A) of FIG. 1) of the elastic band toward a second side (e.g., right side as shown in part (A) of FIG. 1) of the elastic band opposite the first side but not reaching the second side; and (2) a second group of indentations 114 extending from the second side of the elastic band toward the first side of the elastic band but not reaching the first side. Under the proposed scheme, the first group of indentations 112 and the second group of indentations 114 may be interleaved with each other, as shown in part (A) of FIG. 1. As shown in part (B) of FIG. 1, the plurality of indentations on second surface 120 may include: (3) a third group of indentations 122 extending from the first side (e.g., right side as shown in part (B) of FIG. 1) of the elastic band toward the second side (e.g., left side as shown in part (B) of FIG. 1) of the elastic band but not reaching the second side; and (4) a fourth group of indentations 124 extending from the second side of the elastic band toward the first side of the elastic band but not reaching the first side. Under the proposed scheme, the third group of indentations 122 and the fourth group of indentations 124 may be interleaved with each other.

Each of FIG. 2-FIG. 8 respectively illustrates an example scenario involving an apparatus 50 in accordance with an implementation of the present disclosure. Apparatus may include configurable cable holder 100, cable 200 and at least a portion of a firearm 300. Referring to FIG. 1-FIG. 8, configurable cable holder 100, as an elastic band, may be configured with a clamp portion 130 which may protrude from either first surface 110 or second surface 120. For simplicity, in each of FIG. 1-FIG. 8, clamp portion 130 is shown to protrude from first surface 110. Moreover, in some implementations, there may be multiple claim portions 130 protruding from either or both of first surface 110 and second surface 120. Functionally, clamp portion 130 may be configured to elastically clamp a portion (e.g., cable 200) of an accessory (not shown) of firearm 300. As shown in FIG. 1, clamp portion 130 may include a first half portion 132 and a second half portion 134 separate by a gap 135 therebetween with a section of gap 135 being shaped to accommodate cable 200 therein. For instance, each of a portion of first half portion 132 and a corresponding portion of second half portion 134, which may form the section of gap 135 shaped to accommodate cable 200 therein, may be shaped as a concave to respectively accommodate one half of cable 200.

Figure 2:
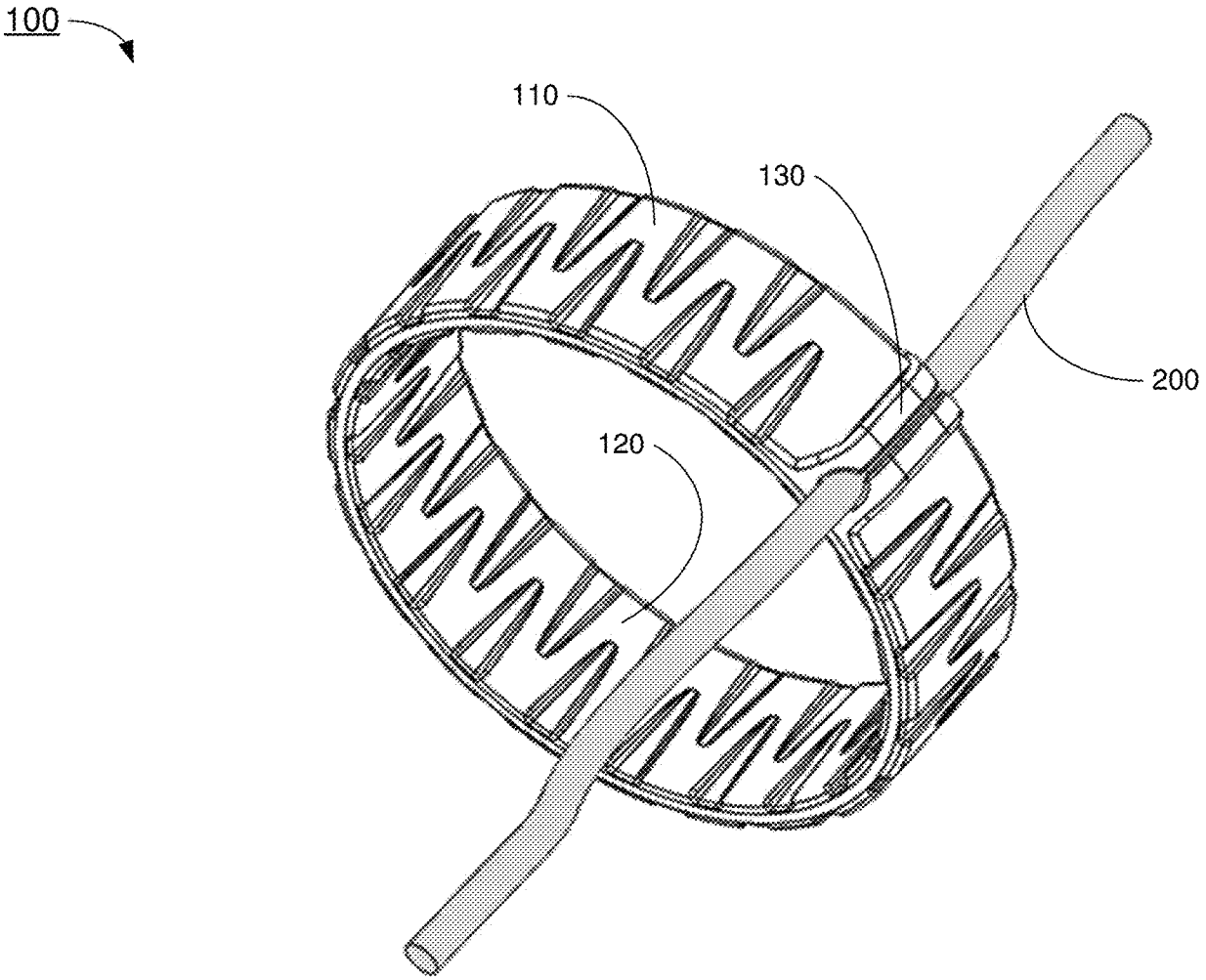
FIG. 2 is a diagram of an example scenario in accordance with an implementation of the present disclosure.
Figure 3:
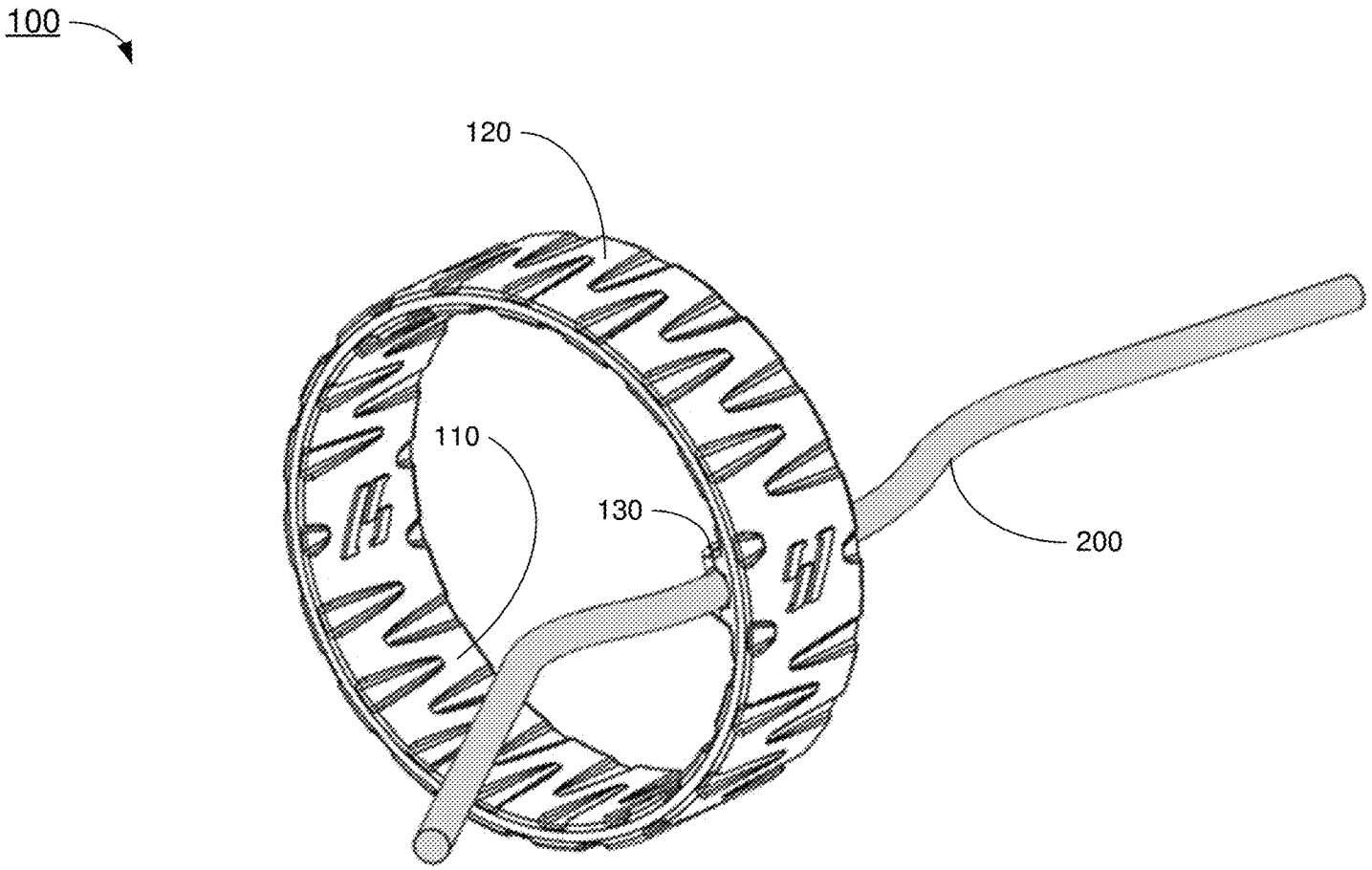
FIG. 3 is a diagram of an example scenario in accordance with an implementation of the present disclosure.
Figure 4:
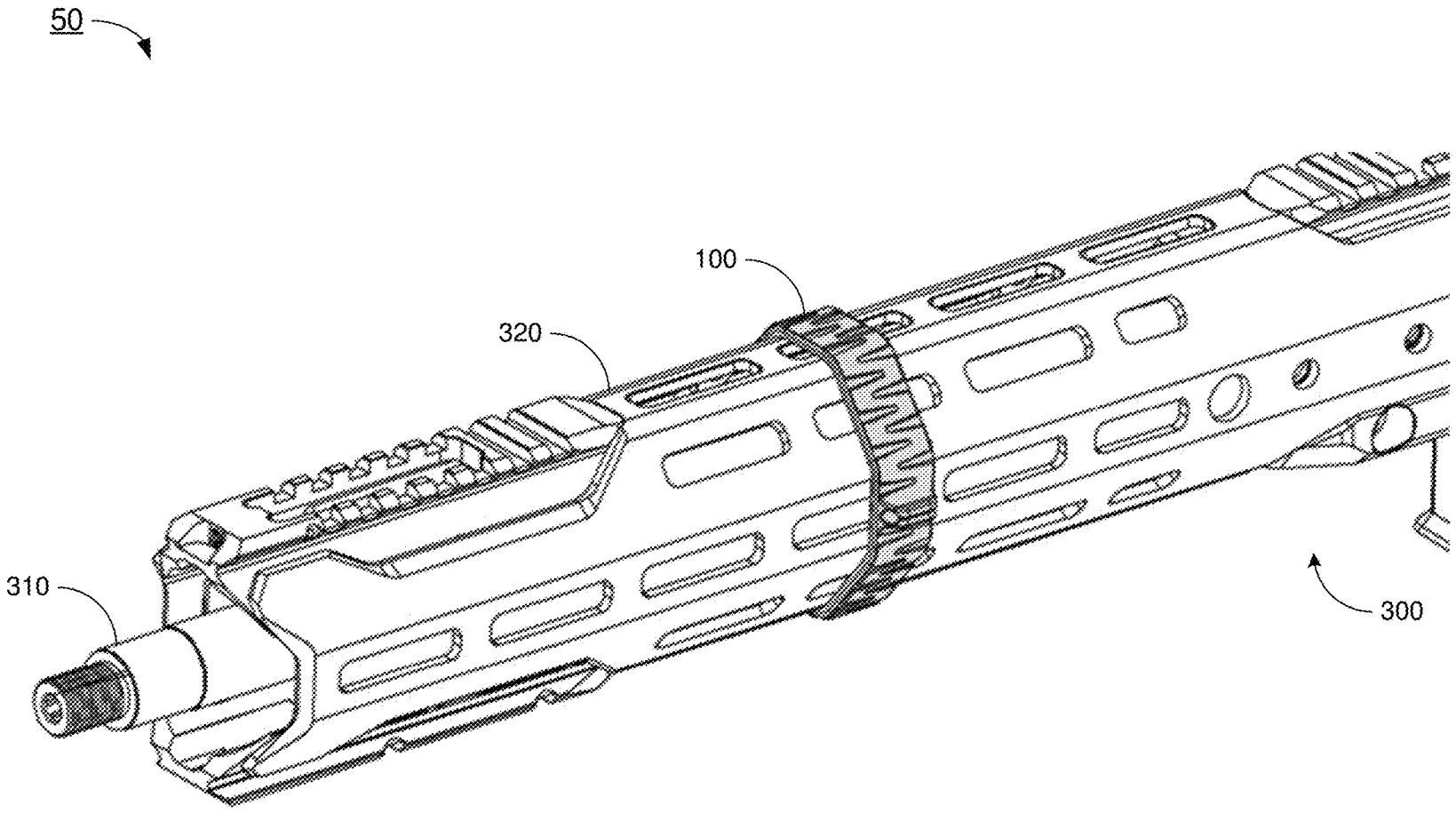
FIG. 4 is a diagram of an example scenario in accordance with an implementation of the present disclosure.
Figure 5:
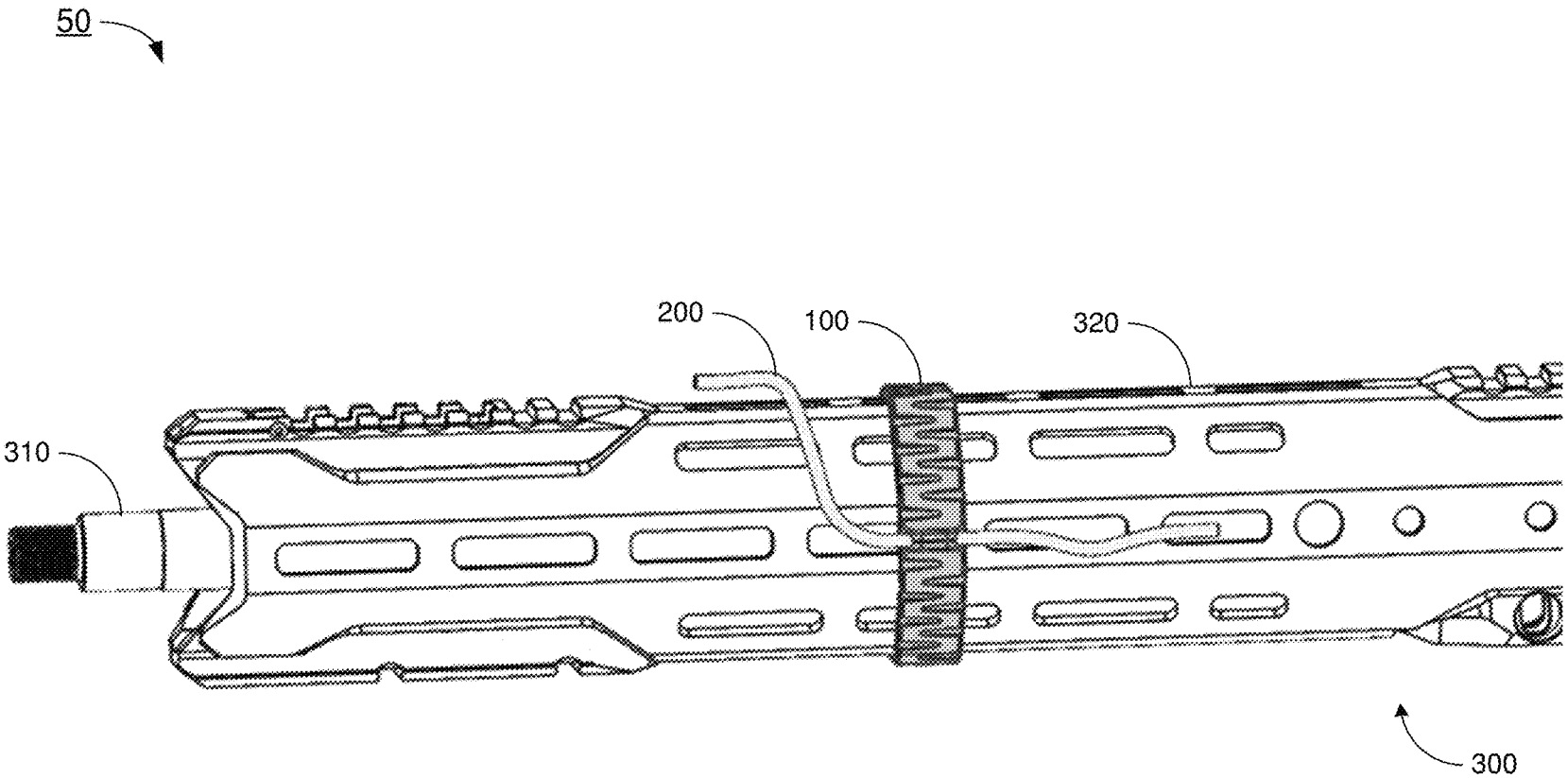
FIG. 5 is a diagram of an example scenario in accordance with an implementation of the present disclosure.
Figure 6:
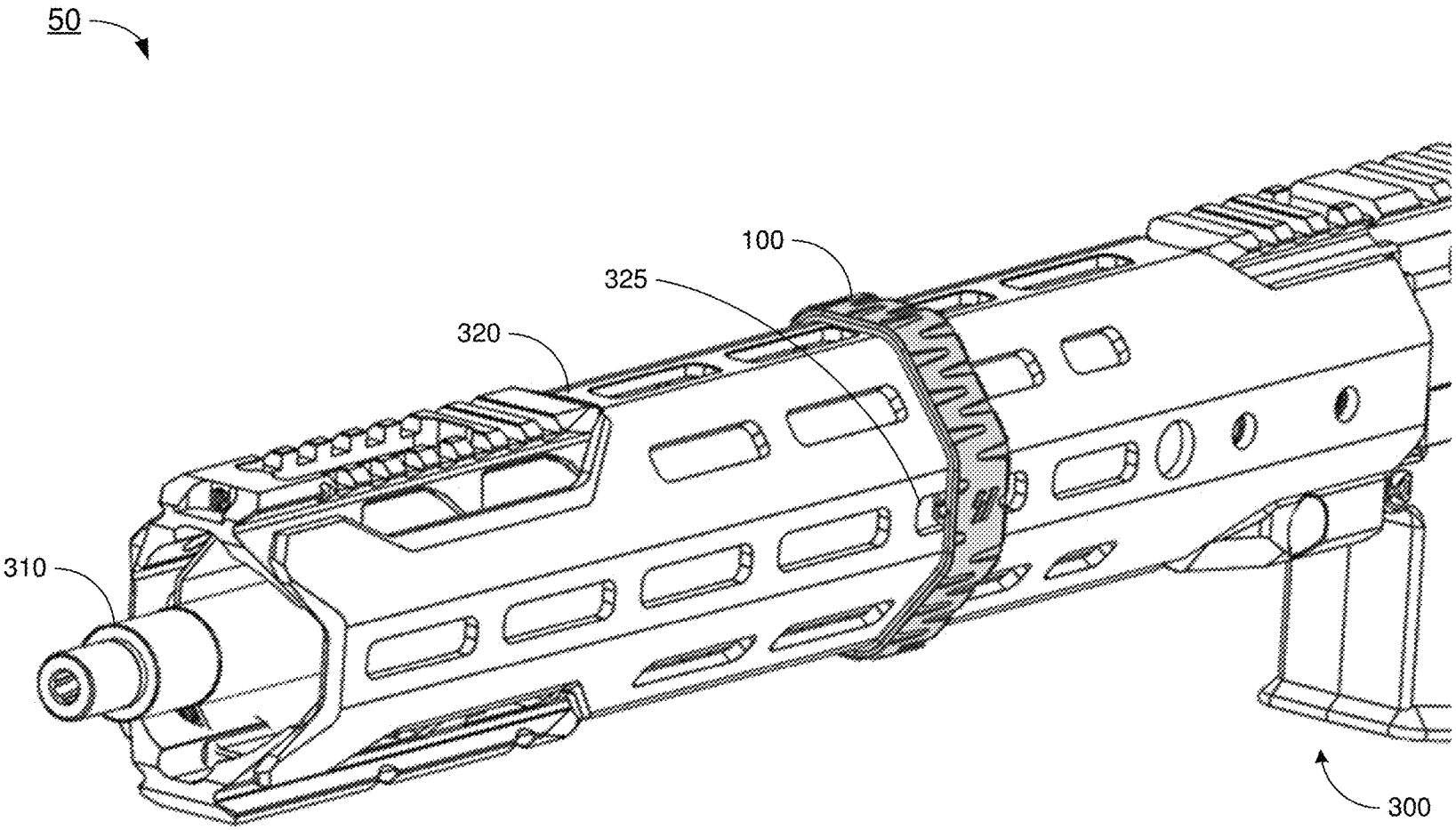
FIG. 6 is a diagram of an example scenario in accordance with an implementation of the present disclosure.
Figure 7:
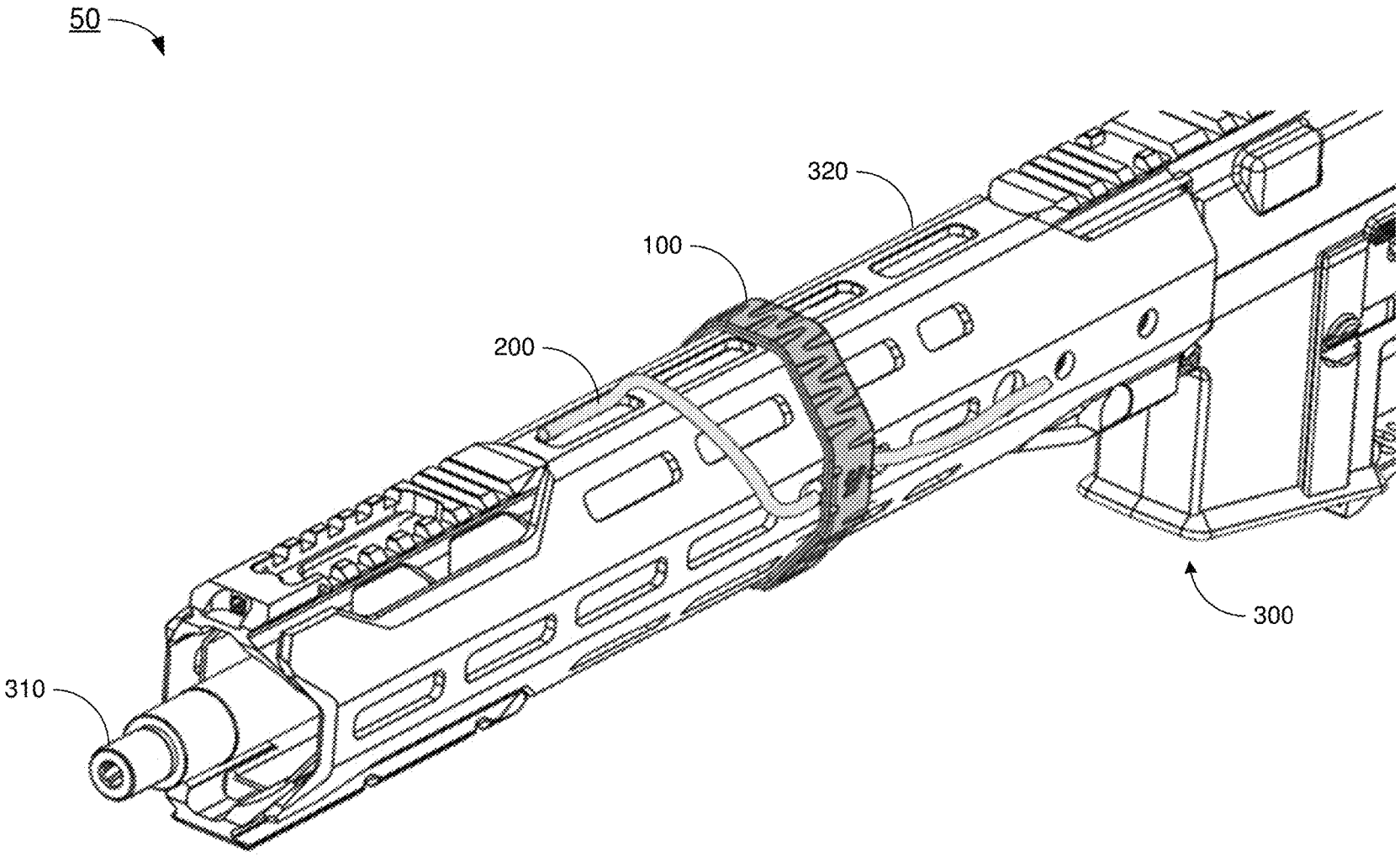
FIG. 7 is a diagram of an example scenario in accordance with an implementation of the present disclosure.

Each of FIG. 2-FIG. 8 respectively illustrates an example scenario involving an apparatus 50 in accordance with an implementation of the present disclosure. Specifically, FIG. 2 shows configurable cable holder 100 in the first configuration and holding a cable 200. FIG. 3 shows configurable cable holder 100 in the second configuration and holding cable 200. FIG. 4 shows configurable cable holder 100 in the first configuration and wrapped around a handguard 320 of firearm 300, with handguard 320 surrounding a barrel 310 of firearm 300. FIG. 5 shows configurable cable holder 100 holding cable 200 in the first configuration and wrapped around a handguard 320 of firearm 300. As shown in FIG. 5, in the first configuration, cable 200 may be routed along an exterior surface of handguard 320. FIG. 6 shows configurable cable holder 100 in the second configuration and wrapped around handguard 320 of firearm 300, with clamp portion 130 inserted into a hole 325 on handguard 320 of firearm 300. FIG. 7 shows configurable cable holder 100 holding cable 200 in the second configuration and wrapped around handguard 320 of firearm 300, with clamp portion 130 inserted into a hole 325 on handguard 320 of firearm 300. As shown in FIG. 7, in the second configuration, at least part of cable 200 may be routed between handguard 320 and configurable cable holder 100.

Under a proposed scheme in accordance with the present disclosure, when the elastic band wraps around a portion (e.g., handguard 320) of firearm 300 in the first configuration, clamp portion 130 may protrude away from firearm 300. Moreover, when the elastic band wraps around the portion of firearm 300 in the second configuration, clamp portion 130 may protrude toward firearm 300. Under the proposed scheme, an exterior dimension (e.g., a width) of clamp portion 130 may be configured to allow clamp portion 130 to snugly fit in a hole 325 on handguard 320 of firearm 300 when the elastic band wraps around handguard 320 of firearm 300 in the second configuration. For instance, the exterior dimension of clamp portion 130 may be configured to allow clamp portion 130 to snugly fit in an M-LOK hole, a KeyMod hole or a proprietary hole on handguard 320 of firearm 300, with claim portion 130 inserted into one of multiple M-LOK holes or KeyMod holes on handguard 325, as shown in FIG. 6-FIG. 8.

Figure 8:
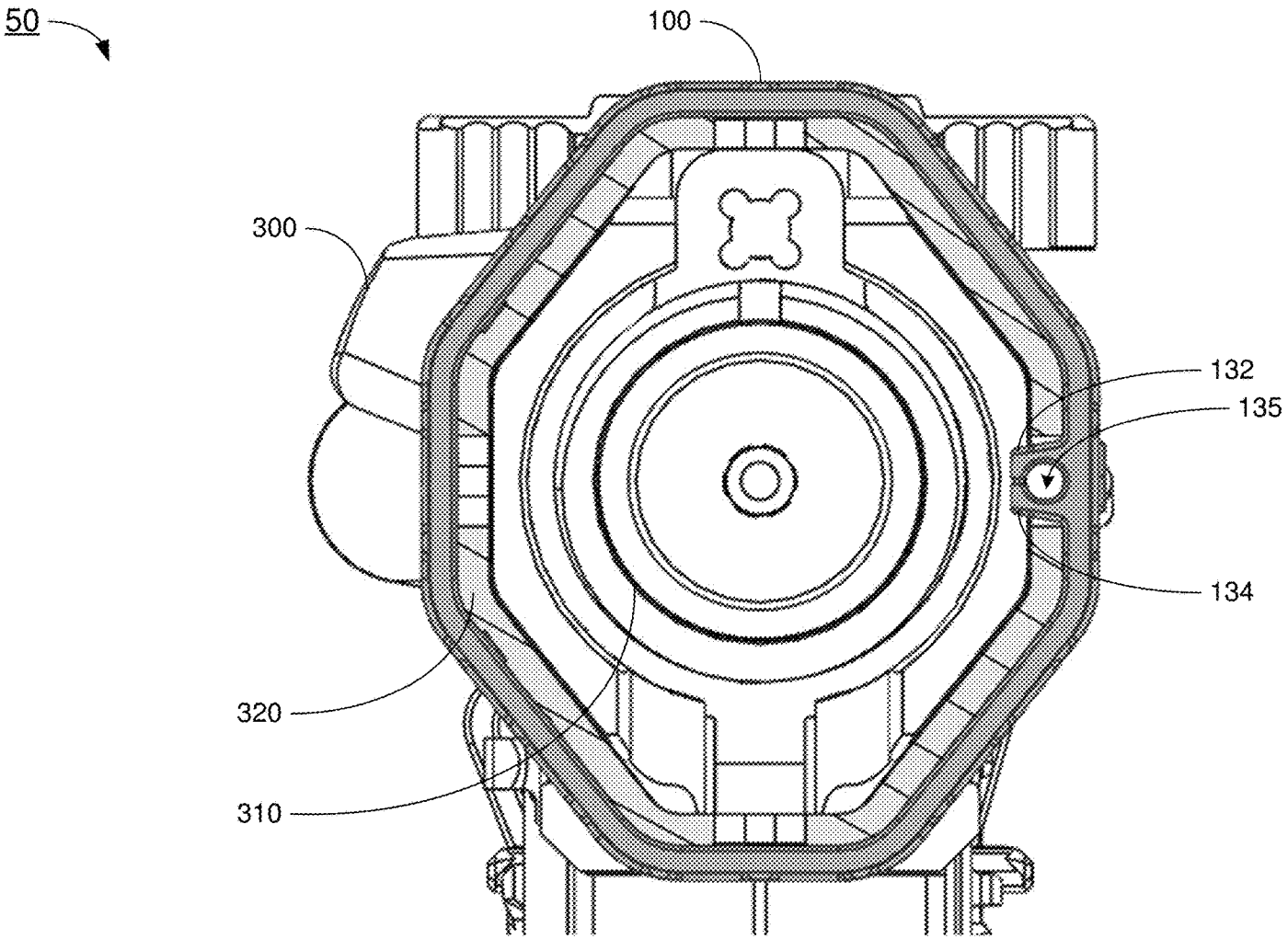
FIG. 8 is a diagram of an example scenario in accordance with an implementation of the present disclosure.

FIG. 8 shows a front view of apparatus 50 (and firearm 300) looking down barrel 310 from the front of firearm 300 toward the back of firearm 300. In the example shown in FIG. 8, configurable cable holder 100, as an elastic band, wraps around handguard 320 in the second configuration with clamp portion 130 protruding toward (or inwardly) handguard 320. Specifically, clamp portion 130 is inserted through and snugly fitted in one of the M-LOK holes or KeyMod holes (e.g., hole 325) on handguard 320. Under a proposed scheme in accordance with the present disclosure, an exterior dimension (e.g., width) of clamp portion 130 is slightly smaller than the width of the holes on handguard 320 to allow snug-fit of first half portion 132 and second half portion 134 of clamp port 130 in one of the holds (e.g., hole 325) on handguard 320. Advantageously, in addition to the anti-slip textured design of the first group of indentations 112 and second group of indentations 114, the fact that clam portion 130 is inserted in one of the holes on handguard 320 may prevent at least a section of cable 200 from being unruly (e.g., freely or otherwise loosely moving).

Feature Highlight

In view of the above, select features of various implementations in accordance with the present disclosure are highlighted below.

In one aspect, a device implementable on a firearm (e.g., a firearm based on the AR-15, AR-10 or AK platform) may include an elastic band configured to wrap around a portion of the firearm (e.g., handguard, grip or buttstock) in one of a plurality of configurations when installed on the firearm. The elastic band may have a clamp portion configured to elastically clamp a portion (e.g., cable) of an accessory of the firearm.

In some implementations, the elastic band may have a first surface and a second surface opposite the first surface. Moreover, the elastic band may be configured to wrap around the portion of the firearm in either a first configuration or a second configuration of the plurality of configurations. For instance, when in the first configuration, the first surface may physically contact the portion of the firearm while the second surface faces away from the portion of the firearm. Similarly, when in the second configuration, the second surface may physically contact the portion of the firearm while the first surface faces away from the portion of the firearm.

In some implementations, the clamp portion may protrude from either the first surface or the second surface. Additionally, the clamp portion may include a first half portion and a second half portion separate by a gap therebetween with a section of the gap being shaped to accommodate a cable therein.

In some implementations, an exterior dimension of the clamp portion may be configured to allow the clamp portion to snugly fit in a hole on the firearm. For instance, the exterior dimension of the clamp portion may be configured to allow the clamp portion to snugly fit in a Modular Lock (M-LOK) hole or a KeyMod hole on the firearm.

In some implementations, the elastic band may have a first surface and a second surface opposite the first surface. In some implementations, each of the first surface and the second surface may be textured to provide an anti-slip effect. For instance, each of the first surface and the second surface may be textured with a plurality of indentations, respectively.

In some implementations, the plurality of indentations on the first surface may include: (1) a first group of indentations extending from a first side of the elastic band toward a second side of the elastic band opposite the first side but not reaching the second side; and (2) a second group of indentations extending from the second side of the elastic band toward the first side of the elastic band but not reaching the first side. In some implementations, the first group of indentations and the second group of indentations may be interleaved with each other. In some implementations, the plurality of indentations on the second surface may include: (3) a third group of indentations extending from the first side of the elastic band toward the second side of the elastic band but not reaching the second side; and (4) a fourth group of indentations extending from the second side of the elastic band toward the first side of the elastic band but not reaching the first side. In some implementations, the third group of indentations and the fourth group of indentations may be interleaved with each other.

In some implementations, the elastic band may be made of NBR, rubber, TPU, or silicone.

In another aspect, a device implementable on a firearm (e.g., a firearm based on the AR-15, AR-10 or AK platform) may include an elastic band configured to wrap around a portion of the firearm (e.g., handguard, grip or buttstock) in one of a plurality of configurations when installed on the firearm. The elastic band may have a clamp portion configured to elastically clamp a portion (e.g., cable) of an accessory of the firearm. In some implementations, when the elastic band wraps around the portion of the firearm in a first configuration of the plurality of configurations, the clamp portion may protrude away from the firearm. Moreover, when the elastic band wraps around the portion of the firearm in a second configuration of the plurality of configurations, the clamp portion may protrude toward the firearm.

In some implementations, the elastic band may have a first surface and a second surface opposite the first surface. Accordingly, when in the first configuration, the first surface may physically contact the portion of the firearm. Moreover, when in the second configuration, the second surface may physically contact the portion of the firearm.

In some implementations, the clamp portion may protrude from either the first surface or the second surface. Additionally, the clamp portion may include a first half portion and a second half portion separate by a gap therebetween with a section of the gap being shaped to accommodate a cable therein.

In some implementations, an exterior dimension of the clamp portion may be configured to allow the clamp portion to snugly fit in a hole on the firearm when the elastic band wraps around the portion of the firearm in the second configuration. For instance, the exterior dimension of the clamp portion may be configured to allow the clamp portion to snugly fit in an M-LOK hole or a KeyMod hole on the firearm.

In some implementations, the elastic band may have a first surface and a second surface opposite the first surface. In some implementations, each of the first surface and the second surface may be textured to provide an anti-slip effect. For instance, each of the first surface and the second surface may be textured with a plurality of indentations, respectively.

In some implementations, the plurality of indentations on the first surface may include: (1) a first group of indentations extending from a first side of the elastic band toward a second side of the elastic band opposite the first side but not reaching the second side; and (2) a second group of indentations extending from the second side of the elastic band toward the first side of the elastic band but not reaching the first side. In some implementations, the first group of indentations and the second group of indentations may be interleaved with each other. In some implementations, the plurality of indentations on the second surface may include: (3) a third group of indentations extending from the first side of the elastic band toward the second side of the elastic band but not reaching the second side; and (4) a fourth group of indentations extending from the second side of the elastic band toward the first side of the elastic band but not reaching the first side. In some implementations, the third group of indentations and the fourth group of indentations may be interleaved with each other.

In some implementations, the elastic band may be made of NBR, rubber, TPU, or silicone.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a firearm, comprising:

an elastic band configured to wrap around a portion of the firearm in one of a plurality of configurations when installed on the firearm, wherein the elastic band has a clamp portion with a through hole configured to elastically clamp a portion of an accessory of the firearm, wherein the elastic band is shaped as a one-piece O-ring, wherein the elastic band has a first surface and a second surface opposite the first surface, wherein the clamp portion protrudes from either the first surface or the second surface, and wherein the through hole is oriented such that, when the portion of the accessory is clamped by the clamp portion, the portion of the accessory traverses through the through hole in a direction that is parallel with either or both of the first surface and the second surface of the elastic band.

2. The device of claim 1, wherein the elastic band is configured to wrap around the portion of the firearm in either a first configuration or a second configuration of the plurality of configurations, wherein, when in the first configuration, the first surface physically contacts the portion of the firearm, and wherein, when in the second configuration, the second surface physically contacts the portion of the firearm.

3. The device of claim 2, and wherein the clamp portion comprises a first half portion and a second half portion separate by a gap therebetween with a section of the gap being shaped to accommodate a cable therein.

4. The device of claim 3, wherein an exterior dimension of the clamp portion is configured to allow the clamp portion to snugly fit in a hole on the firearm.

5. The device of claim 4, wherein the exterior dimension of the clamp portion is configured to allow the clamp portion to snugly fit in a Modular Lock (M-LOK) hole or a KeyMod hole on the firearm.

6. The device of claim 1, wherein the elastic band has a first surface and a second surface opposite the first surface, and wherein each of the first surface and the second surface is textured to provide an anti-slip effect.

7. The device of claim 6, wherein each of the first surface and the second surface is textured with a plurality of indentations, respectively.

8. The device of claim 7, wherein the plurality of indentations on the first surface comprise:

a first group of indentations extending from a first side of the elastic band toward a second side of the elastic band opposite the first side but not reaching the second side; and a second group of indentations extending from the second side of the elastic band toward the first side of the elastic band but not reaching the first side, wherein the first group of indentations and the second group of indentations are interleaved with each other.

9. The device of claim 8, wherein the plurality of indentations on the second surface comprise:

a third group of indentations extending from the first side of the elastic band toward the second side of the elastic band but not reaching the second side; and a fourth group of indentations extending from the second side of the elastic band toward the first side of the elastic band but not reaching the first side, wherein the third group of indentations and the fourth group of indentations are interleaved with each other.

10. The device of claim 1, wherein the elastic band is made of nitrile rubber (NBR), rubber, thermoplastic polyurethane (TPU), or silicone.

11. A device implementable on a firearm, comprising:

an elastic band configured to wrap around a portion of the firearm in one of a plurality of configurations when installed on the firearm, wherein the elastic band has a clamp portion with a through hole configured to elastically clamp a portion of an accessory of the firearm, wherein the elastic band is shaped as a one-piece O-ring, wherein the elastic band has a first surface and a second surface opposite the first surface, wherein the clamp portion protrudes from either the first surface or the second surface, wherein the through hole is oriented such that, when the portion of the accessory is clamped by the clamp portion, the portion of the accessory traverses through the through hole in a direction that is parallel with either or both of the first surface and the second surface of the elastic band, wherein, when the elastic band wraps around the portion of the firearm in a first configuration of the plurality of configurations, the clamp portion protrudes away from the firearm, and wherein, when the elastic band wraps around the portion of the firearm in a second configuration of the plurality of configurations, the clamp portion protrudes toward the firearm.

12. The device of claim 11, wherein, when in the first configuration, the first surface physically contacts the portion of the firearm, and wherein, when in the second configuration, the second surface physically contacts the portion of the firearm.

13. The device of claim 12, wherein the clamp portion comprises a first half portion and a second half portion separate by a gap therebetween with a section of the gap being shaped to accommodate a cable therein.

14. The device of claim 13, wherein an exterior dimension of the clamp portion is configured to allow the clamp portion to snugly fit in a hole on the firearm when the elastic band wraps around the portion of the firearm in the second configuration.

15. The device of claim 14, wherein the exterior dimension of the clamp portion is configured to allow the clamp portion to snugly fit in a Modular Lock (M-LOK) hole or a KeyMod hole on the firearm.

16. The device of claim 11, wherein the elastic band has a first surface and a second surface opposite the first surface, and wherein each of the first surface and the second surface is textured to provide an anti-slip effect.

17. The device of claim 16, wherein each of the first surface and the second surface is textured with a plurality of indentations, respectively.

18. The device of claim 17, wherein the plurality of indentations on the first surface comprise:

a first group of indentations extending from a first side of the elastic band toward a second side of the elastic band opposite the first side but not reaching the second side; and a second group of indentations extending from the second side of the elastic band toward the first side of the elastic band but not reaching the first side, wherein the first group of indentations and the second group of indentations are interleaved with each other.

19. The device of claim 18, wherein the plurality of indentations on the second surface comprise:

a third group of indentations extending from the first side of the elastic band toward the second side of the elastic band but not reaching the second side; and a fourth group of indentations extending from the second side of the elastic band toward the first side of the elastic band but not reaching the first side, wherein the third group of indentations and the fourth group of indentations are interleaved with each other.

20. The device of claim 11, wherein the elastic band is made of nitrile rubber (NBR), rubber, thermoplastic polyurethane (TPU), or silicone.

* * * * *